US005771053A

United States Patent [19]

Merrill

[11] Patent Number: 5,771,053

[45] Date of Patent: Jun. 23, 1998

[54] ASSEMBLY FOR CONTROLLING INK RELEASE FROM A CONTAINER

[75] Inventor: David O. Merrill, Corvallis, Oreg.

[73] Assignee: Hewlett-Packard Company, Palo Alto, Calif.

[21] Appl. No.: 566,643

[22] Filed: Dec. 4, 1995

[51] Int. Cl.[6] ..... B41J 2/175

[52] U.S. Cl. ..... 347/86

[58] Field of Search ..... 347/84, 85, 86

[56] References Cited

U.S. PATENT DOCUMENTS

| | | |
|---|---|---|
| 594,196 | 11/1897 | Cramer . |
| 714,264 | 11/1902 | Turajski . |
| 743,798 | 11/1903 | Allwardt . |
| 1,150,420 | 8/1915 | Davis . |
| 1,304,814 | 5/1919 | Schweinert . |
| 1,451,037 | 4/1923 | Blanchard . |
| 1,563,331 | 12/1925 | Bright . |
| 1,588,898 | 6/1926 | Martocello . |
| 1,638,488 | 8/1927 | Kellogg . |
| 1,759,872 | 5/1930 | Schwimmer . |
| 1,767,391 | 6/1930 | Muller . |
| 1,850,879 | 3/1932 | Hunt . |
| 1,859,018 | 5/1932 | Bedford . |
| 1,918,602 | 7/1933 | Joyce . |
| 2,011,639 | 8/1935 | Johannesson . |
| 2,024,682 | 12/1935 | Eisenman . |
| 2,086,569 | 7/1937 | Meyer . |
| 2,092,116 | 9/1937 | Hansen . |
| 2,258,919 | 10/1941 | Wallace . |
| 2,265,267 | 12/1941 | Cowles . |
| 2,288,565 | 6/1942 | Green . |
| 2,327,611 | 8/1943 | Scheiwer . |
| 2,370,182 | 2/1945 | Morrow . |
| 2,373,886 | 4/1945 | Geiger . |
| 2,412,685 | 4/1946 | Hofman et al. . |
| 2,434,167 | 1/1948 | Knoblauch . |
| 2,459,477 | 1/1949 | Schuyver . |
| 2,492,271 | 12/1949 | Cox . |
| 2,557,807 | 6/1951 | Wagner . |
| 2,598,009 | 5/1952 | Peeps . |
| 2,612,389 | 9/1952 | MacGlashan . |
| 2,727,759 | 12/1955 | Elliott . |
| 2,789,838 | 4/1957 | Palm . |
| 2,842,382 | 7/1958 | Franck . |
| 2,888,173 | 5/1959 | Wolcott . |
| 2,915,325 | 12/1959 | Foster . |
| 2,919,935 | 1/1960 | Nyberg . |
| 2,925,103 | 2/1960 | Kerr . |
| 3,102,770 | 9/1963 | McKeegan . |
| 3,104,088 | 9/1963 | Cator . |
| 3,106,379 | 10/1963 | Sciuto . |
| 3,140,912 | 7/1964 | Davis . |
| 3,152,452 | 10/1964 | Bond, Jr. . |
| 3,157,314 | 11/1964 | Nadler . |
| 3,170,667 | 2/1965 | Szohatzky . |
| 3,223,117 | 12/1965 | Curie . |
| 3,230,964 | 1/1966 | Debrotnic . |
| 3,279,497 | 10/1966 | Norton . |
| 3,339,883 | 9/1967 | Drake . |
| 3,359,015 | 12/1967 | Zahuranec . |
| 3,430,824 | 3/1969 | Conners . |
| 3,490,473 | 1/1970 | Ehrens . |
| 3,493,146 | 2/1970 | Conners . |
| 3,537,477 | 11/1970 | Mahoff . |
| 3,613,959 | 10/1971 | Mason . |
| 3,614,940 | 10/1971 | Abrams et al. . |
| 3,640,309 | 2/1972 | Demier, Sr. . |
| 3,708,798 | 1/1973 | Hildenbrand . |
| 3,777,771 | 12/1973 | De Visscher . |
| 3,777,782 | 12/1973 | Shendure . |
| 3,787,882 | 1/1974 | Fillmore . |
| 3,805,276 | 4/1974 | Ishii . |
| 3,825,222 | 7/1974 | Petrova . |
| 3,831,727 | 8/1974 | Kruspe . |
| 3,873,062 | 3/1975 | Johnson . |
| 3,896,853 | 7/1975 | Bernhard . |

(List continued on next page.)

*Primary Examiner*—Adolf Berhane

[57] ABSTRACT

The assembly includes a valve member that occludes and releases ink flow from the container. The valve member also has a head that moves to open an air vent as ink is being released and to close the vent when ink flow is occluded. The valve member may be operated automatically or manually.

22 Claims, 1 Drawing Sheet

U.S. PATENT DOCUMENTS

| | | | |
|---|---|---|---|
| 3,924,654 | 12/1975 | Buller . | |
| 3,950,761 | 4/1976 | Kashio . | |
| 3,961,337 | 6/1976 | Jung . | |
| 4,053,901 | 10/1977 | Skafvenstedt . | |
| 4,053,902 | 10/1977 | Skafvenstedt . | |
| 4,074,284 | 2/1978 | Dexter . | |
| 4,079,384 | 3/1978 | Takano . | |
| 4,084,165 | 4/1978 | Skafvenstedt . | |
| 4,114,853 | 9/1978 | Medvick . | |
| 4,119,034 | 10/1978 | Wax . | |
| 4,122,457 | 10/1978 | Erickson . | |
| 4,126,868 | 11/1978 | Kirner . | |
| 4,131,899 | 12/1978 | Christou . | |
| 4,142,653 | 3/1979 | Masica . | |
| 4,149,172 | 4/1979 | Heinzl . | |
| 4,156,244 | 5/1979 | Erickson . | |
| 4,178,595 | 12/1979 | Jinnai . | |
| 4,183,031 | 1/1980 | Kyser et al. | 347/86 |
| 4,187,511 | 2/1980 | Robinson . | |
| 4,204,215 | 5/1980 | Nakarai . | |
| 4,234,885 | 11/1980 | Arway . | |
| 4,253,103 | 2/1981 | Heinzl . | |
| 4,263,602 | 4/1981 | Matsumoto . | |
| 4,270,133 | 5/1981 | Shimazawa . | |
| 4,287,523 | 9/1981 | Thomas . | |
| 4,303,929 | 12/1981 | Blanck . | |
| 4,320,407 | 3/1982 | Goldis . | |
| 4,323,907 | 4/1982 | Italiano . | |
| 4,324,239 | 4/1982 | Gordon . | |
| 4,329,698 | 5/1982 | Smith . | |
| 4,339,761 | 7/1982 | Matsumoto . | |
| 4,340,896 | 7/1982 | Cruz-Uribe . | |
| 4,342,041 | 7/1982 | Kasugayama . | |
| 4,342,042 | 7/1982 | Cruz-Uribe . | |
| 4,345,627 | 8/1982 | Cassia . | |
| 4,357,617 | 11/1982 | Shimazawa . | |
| 4,371,004 | 2/1983 | Sysolin . | |
| 4,376,283 | 3/1983 | Bower . | |
| 4,380,772 | 4/1983 | Italiano . | |
| 4,383,263 | 5/1983 | Ozawa . | |
| 4,394,669 | 7/1983 | Ozawa . | |
| 4,403,229 | 9/1983 | Bartek . | |
| 4,412,232 | 10/1983 | Weber . | |
| 4,413,267 | 11/1983 | Hein . | |
| 4,419,677 | 12/1983 | Kasugayama . | |
| 4,421,296 | 12/1983 | Stephens . | |
| 4,422,084 | 12/1983 | Saito . | |
| 4,422,086 | 12/1983 | Miura . | |
| 4,429,320 | 1/1984 | Hattori . | |
| 4,433,341 | 2/1984 | Thomas . | |
| 4,447,820 | 5/1984 | Terasawa . | |
| 4,456,916 | 6/1984 | Kocot . | |
| 4,460,904 | 7/1984 | Oszczakiewicz . | |
| 4,462,037 | 7/1984 | Bangs . | |
| 4,471,364 | 9/1984 | Kocot . | |
| 4,475,116 | 10/1984 | Sicking . | |
| 4,476,472 | 10/1984 | Aiba . | |
| 4,496,959 | 1/1985 | Frerichs . | |
| 4,496,960 | 1/1985 | Fischbeck . | |
| 4,498,658 | 2/1985 | Mikiya . | |
| 4,500,895 | 2/1985 | Buck . | |
| 4,502,059 | 2/1985 | Blessington . | |
| 4,506,276 | 3/1985 | Kyser et al. | 347/86 |
| 4,506,862 | 3/1985 | Spinosa . | |
| 4,509,659 | 4/1985 | Cloutier . | |
| 4,511,906 | 4/1985 | Hara . | |
| 4,520,369 | 5/1985 | Shackleton . | |
| 4,527,170 | 7/1985 | Iwasaki . | |
| 4,527,175 | 7/1985 | Kojima . | |
| 4,536,777 | 8/1985 | Matsumoto . | |
| 4,541,457 | 9/1985 | Blenkush . | |
| 4,542,386 | 9/1985 | Delligatii . | |
| 4,542,390 | 9/1985 | Bruning . | |
| 4,555,719 | 11/1985 | Arway . | |
| 4,558,326 | 12/1985 | Kimura . | |
| 4,568,954 | 2/1986 | Rosback . | |
| 4,575,738 | 3/1986 | Sheufelt . | |
| 4,576,199 | 3/1986 | Svensson . | |
| 4,586,058 | 4/1986 | Yamazaki . | |
| 4,590,494 | 5/1986 | Ichihashi . | |
| 4,591,875 | 5/1986 | McCann . | |
| 4,593,294 | 6/1986 | Parisi . | |
| 4,599,625 | 7/1986 | Terasawa . | |
| 4,600,927 | 7/1986 | Sugitani . | |
| 4,602,662 | 7/1986 | Eremity . | |
| 4,604,633 | 8/1986 | Kimura . | |
| 4,607,261 | 8/1986 | McCann . | |
| 4,609,925 | 9/1986 | Nozu . | |
| 4,610,202 | 9/1986 | Ebimura . | |
| 4,623,905 | 11/1986 | Ichibashi . | |
| 4,628,332 | 12/1986 | Matsumoto . | |
| 4,628,333 | 12/1986 | Terasawa . | |
| 4,630,072 | 12/1986 | Scardovi . | |
| 4,630,758 | 12/1986 | Mutoh . | |
| 4,636,814 | 1/1987 | Terasawa . | |
| 4,639,738 | 1/1987 | Young . | |
| 4,658,272 | 4/1987 | Toganoh . | |
| 4,658,273 | 4/1987 | Yuki . | |
| 4,672,993 | 6/1987 | Bilak . | |
| 4,673,955 | 6/1987 | Ameyama . | |
| 4,677,447 | 6/1987 | Nielsen . | |
| 4,680,696 | 7/1987 | Ebinuma . | |
| 4,683,905 | 8/1987 | Vigneau . | |
| 4,684,962 | 8/1987 | Hirosawa . | |
| 4,689,642 | 8/1987 | Sugitani . | |
| 4,694,307 | 9/1987 | Toganoh . | |
| 4,695,824 | 9/1987 | Tazaki . | |
| 4,699,356 | 10/1987 | Hargrove . | |
| 4,700,202 | 10/1987 | Kuranishi . | |
| 4,700,205 | 10/1987 | Rich . | |
| 4,700,744 | 10/1987 | Rutter . | |
| 4,709,725 | 12/1987 | Morrison . | |
| 4,714,937 | 12/1987 | Kaplinsky . | |
| 4,719,475 | 1/1988 | Kiyohara . | |
| 4,734,711 | 3/1988 | Piatt . | |
| 4,736,774 | 4/1988 | Vonasek . | |
| 4,737,801 | 4/1988 | Ichihashi . | |
| 4,739,347 | 4/1988 | Ishikawa . | |
| 4,739,847 | 4/1988 | Terasawa . | |
| 4,757,331 | 7/1988 | Mizusawa . | |
| 4,760,409 | 7/1988 | Kiyohara . | |
| 4,765,657 | 8/1988 | Cruse . | |
| 4,775,871 | 10/1988 | Abe . | |
| 4,777,497 | 10/1988 | Nozu . | |
| 4,785,314 | 11/1988 | Terasawa . | |
| 4,811,035 | 3/1989 | Huliba . | |
| 4,814,786 | 3/1989 | Hoisington . | |
| 4,814,794 | 3/1989 | Sato . | |
| 4,825,228 | 4/1989 | Gloeckler . | |
| 4,826,052 | 5/1989 | Micallef . | |
| 4,831,389 | 5/1989 | Chan . | |
| 4,844,408 | 7/1989 | Beaston . | |
| 4,849,773 | 7/1989 | Owatari . | |
| 4,853,708 | 8/1989 | Walters . | |
| 4,881,569 | 11/1989 | Fournier . | |
| 4,888,602 | 12/1989 | Watanabe . | |
| 4,896,171 | 1/1990 | Ito . | |
| 4,898,209 | 2/1990 | Zbed . | |
| 4,907,019 | 3/1990 | Stephens . | |
| 4,910,529 | 3/1990 | Regnault . | |
| 4,911,203 | 3/1990 | Garms . | |
| 4,920,360 | 4/1990 | Terasawa . | |

4,926,196 5/1990 Mizoguchi .
4,928,126 5/1990 Asai .
4,929,109 5/1990 Ikenaga .
4,931,044 6/1990 Beiter .
4,931,814 6/1990 Yoshimura .
4,934,655 6/1990 Blenkush .
4,935,751 6/1990 Hamlin .
4,940,995 7/1990 Hine .
4,940,997 7/1990 Hamlin et al. .
4,942,901 7/1990 Vescovini .
4,953,756 9/1990 Breault .
4,957,483 9/1990 Gonser .
4,958,754 9/1990 Dennis .
4,959,667 9/1990 Kaplinsky .
4,961,082 10/1990 Hoisington .
4,967,207 10/1990 Ruder .
4,968,998 11/1990 Allen .
4,970,533 11/1990 Saito .
4,973,993 11/1990 Allen .
4,977,413 12/1990 Yamanaka .
4,987,429 1/1991 Finley .
4,991,820 2/1991 Kohn .
4,992,802 2/1991 Dion .
4,995,940 2/1991 Hine .
4,999,652 3/1991 Chan .
5,002,254 3/1991 Belisaire .
5,008,688 4/1991 Ebinuma .
5,025,270 6/1991 Umezawa .
5,026,024 6/1991 Ito .
5,030,973 7/1991 Nonoyama .
5,043,746 8/1991 Abe .
5,053,787 10/1991 Terasawa .
5,070,347 12/1991 Yuki .
5,074,524 12/1991 Wade .
5,119,115 6/1992 Buat .
5,126,767 6/1992 Asai .
5,136,305 8/1992 Ims .
5,136,309 8/1992 Lida .
5,153,612 10/1992 Dunn .
5,155,502 10/1992 Kimura .
5,159,348 10/1992 Dietl .
5,182,581 1/1993 Kashimura .
5,187,498 2/1993 Burger .
5,189,438 2/1993 Hine .
5,199,470 4/1993 Goldman .
5,206,668 4/1993 Lo et al. .
5,215,231 6/1993 Paczonay .
5,216,452 6/1993 Suzuki .
5,220,345 6/1993 Hirosawa .
5,221,935 6/1993 Uzita .
5,221,936 6/1993 Saito .
5,245,915 9/1993 Ford .
5,255,827 10/1993 Breault .
5,270,739 12/1993 Kitani .
5,280,300 1/1994 Fong .
5,283,593 2/1994 Wehl .
5,289,212 2/1994 Carlotta .
5,293,913 3/1994 Preszler .
5,305,920 4/1994 Reiboldt .
5,306,125 4/1994 Weag .
5,307,091 4/1994 DeCoste, Jr. .
5,311,214 5/1994 Hirasawa .
5,320,326 6/1994 Ju .
5,328,055 7/1994 Battle .
5,329,294 7/1994 Ontawar .
5,331,339 7/1994 Takahashi .
5,337,925 8/1994 Ferrara, Jr. .
5,341,161 8/1994 Yamakawa .
5,343,226 8/1994 Niedermeyeyr .
5,348,192 9/1994 Sardynski .
5,351,073 9/1994 Kageyama .
5,359,353 10/1994 Hunt .
5,359,356 10/1994 Ecklund .
5,359,357 10/1994 Takaki .
5,365,260 11/1994 Kitani .
5,365,262 11/1994 Hattori .
5,368,070 11/1994 Bosley .
5,369,429 11/1994 Erickson .
5,372,306 12/1994 Yianilos .
5,381,172 1/1995 Ujita .
5,385,331 1/1995 Allread .
5,390,702 2/1995 Smith, III .
5,394,177 2/1995 McCann .
5,396,268 3/1995 Mader .
5,400,066 3/1995 Matsumoto .
5,400,573 3/1995 Crystal .
5,402,982 4/1995 Atkinson .
5,406,320 4/1995 Durst .
5,408,256 4/1995 Keen .
5,426,459 6/1995 Kaplinsky .
5,500,663 3/1996 Ujita et al. ..... 347/86
5,646,664 7/1997 Pawlowski, Jr. ..... 347/86

ASSEMBLY FOR CONTROLLING INK RELEASE FROM A CONTAINER

TECHNICAL FIELD

This invention relates to an assembly for controlling the release of ink from an ink container that supplies ink to print heads of an ink-jet printer.

BACKGROUND INFORMATION AND SUMMARY OF THE INVENTION

Ink-jet printers have print heads for selectively ejecting tiny droplets of ink onto paper. In one type of printer, the print head and the primary supply of ink are separate. The ink supply container is stationary, mounted within the printer near the reciprocating print head. The ink is supplied from the ink container to the print head through a tube. The tube is connected to a station on the printer, into which station is plugged the ink container.

A fluid connection between the ink container and the printer station is required to allow the ink to flow from the container into the tube that connects to the print head. It is desirable to make this fluid connection as simple as possible, hence simplifying the control of ink release.

This invention provides a simplified assembly for controlling the release and flow of ink from a container into, for example, the supply tube of an ink-jet printer. The assembly facilitates refilling of the container by the user. The assembly can be produced from the same material as the ink container, making the unit easy to recycle.

A preferred embodiment of the invention includes an ink container that carries a movable valve member which, when moved into one position, allows ink to flow from the otherwise sealed container. The valve member may be configured not only to occlude and release the flow of ink from the ink container, but to simultaneously open and close an air vent in the container. The vent permits release of all ink from a rigid container.

As another aspect of this invention, the movable valve member is manually operable. To this end, the valve member is provided with a grip, or is connected to an external manually actuated slide mounted to the container.

DESCRIPTION OF PREFERRED EMBODIMENTS

Figure 1:
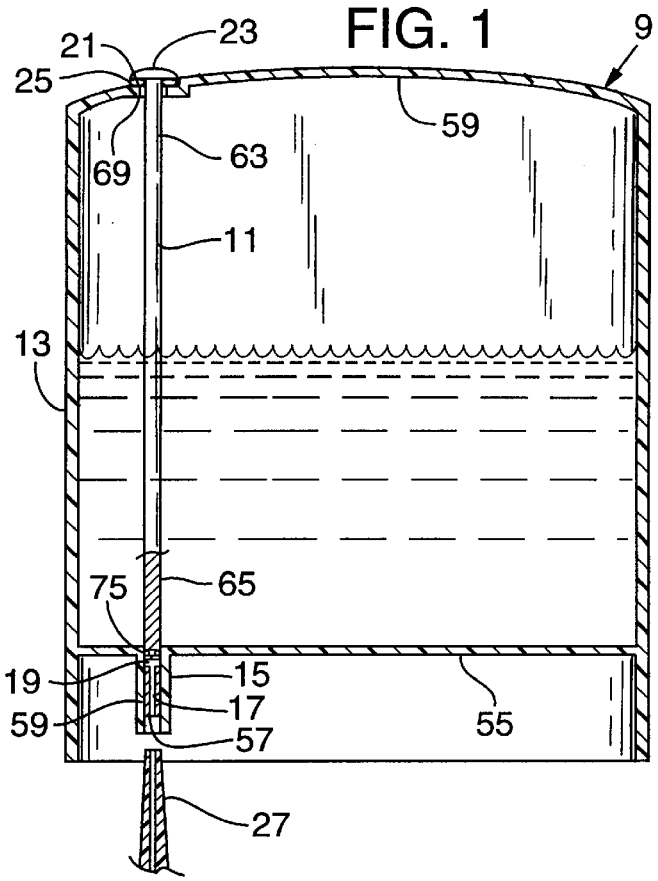
FIG. 1 is a front elevation view, partly in cross-section, of an assembly for controlling the release of ink from a container, showing the valve member in position to occlude the flow.

An assembly for controlling the release of ink in accordance with the present invention is illustrated in FIG. 1 as reference number 9. The assembly 9 includes a container 13 and a valve member 11. The container 13 has a projecting tubular sleeve 15 formed in one end 55. An aperture 21 is formed on an opposite end 59 of the container 13, axially aligned with the sleeve 15.

Figure 2:
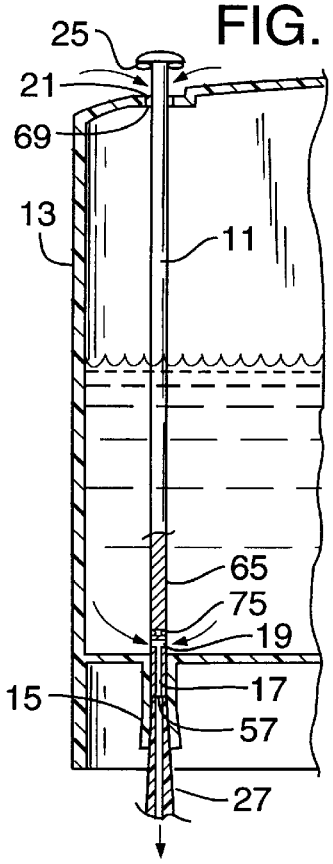
FIG. 2 is a view, like FIG. 1, showing the valve member in a position to allow ink to flow from the container and to allow air to flow into the container.

The valve member 11 is slidably mounted within the sleeve 15 and the aperture 21. The lower end 65 of valve member 11 is provided with a central bore 17 in the end of the valve member that fits within the sleeve 15. The bore 17 has at least one inlet 19. The inlet 19 is lateral to the axis of the valve member 11 and extends between the exterior of the valve member 11 and its bore 17. Preferably, the inlet 19 comprises a through-hole that forms a "Tee" with the bore 17, as shown in FIG. 2. When the valve member 11 is in an open position, the inlet 19 and the bore 17 provide a path for ink to flow from the interior of the container 13, out of the bore 17, and through the opening of the sleeve 15, as explained below.

The upper end 63 of the valve member 11 extends through the aperture 21. The part of that upper end 63 that protrudes from the container 13 is provided with a head 23. The head 23 is slightly larger than the aperture 21 and is provided with a sealing member 25 (such as an O-ring or integrally-formed annulus) such that when the head 23 is in a closed position, as illustrated in FIG. 1, there is no fluid communication through the aperture 21 between the inside of the container 13 and the ambient air.

When the valve member 11 is in a closed position, as shown in FIG. 1, the ends of the inlet 19 contact the interior walls 59 of the sleeve 15, thus occluding ink flow out of the container 13.

The valve member 11 is movable into an open position, as shown in FIG. 2, as a result of moving the container 13 into the printer station to contact a tubular stationary member 27 (FIG. 2). The stationary member 27 fits snugly into the sleeve 15 (deforming somewhat) as the container 13 is moved against it (downwardly in FIG. 2). The outermost end of the stationary member 27 contacts the face 57 of the valve member 11, pushing the valve member 11 into an open position, as shown in FIG. 2. In an open position, the inlet 19 is exposed for fluid communication with the ink in the container 13, and ink can flow from the container 13 through the path defined by the inlet 19 and bore 17. Also, as the valve member 11 is pushed, the head 23 is raised, providing fluid communication between the ambient air and the inside of the container 13.

It is noteworthy here that the annular space 69 formed between the aperture 21 and the valve member 11 has a cross-sectional area-to-length ratio sufficient to prevent vapor loss from the container 13. The dimensions for cross-sectional area and length can be determined by one of ordinary skill in the art using Fick's Laws of Diffusion, which declare that vapor loss is proportional to the cross-sectional area of an aperture and inversely proportional to the length of the aperture.

Figure 3:
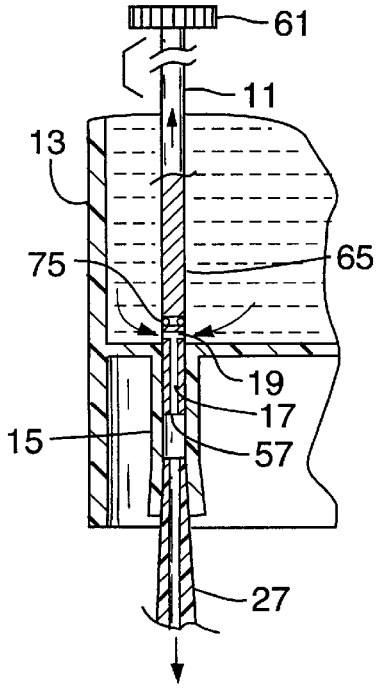
FIG. 3 is another embodiment of the assembly in which the valve member includes a manual grip.

The head 23 of the valve member 11 may be provided with a grip 61 (FIG. 3). The grip 61 can be used to manually move the valve member 11 from the closed position to the open position, instead of relying on automatic actuation by, for example, the stationary member 27.

Figure 4:
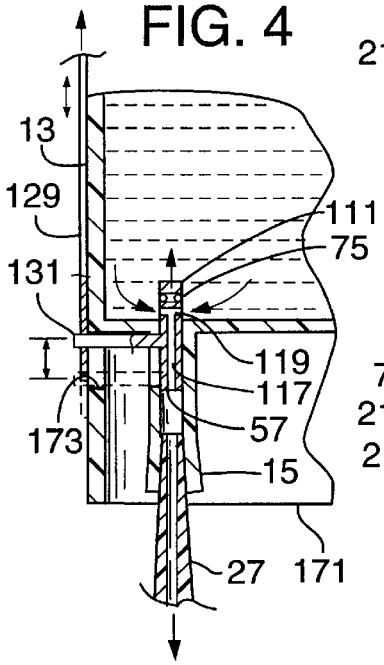
FIG. 4 is another embodiment of the assembly in which the valve member is actuated by an external slide.

FIG. 4 shows an alternative mechanism for moving a valve member 111 to expose the inlet 119 for fluid communication with the inside of the container 13. The valve member 111, associated inlet 119 and bore 117 generally conform to that of member 11 described above in connection with FIGS. 1 and 2. The valve member 111 is connected to a link member 131, shown extending perpendicular to the axis of the valve member 111. The link member 131 is connected to a slide 129 that is mounted on the exterior of the container 13. The slide 129 is slidable from a first position (dashed lines FIG. 4), in which the valve member 111 is in a closed position, to a second position, such that the attached link member 131, moves the valve member 111 into an open position (solid lines, FIG. 4) exposing the inlet 119 and providing ink flow from container 13.

The container 13 has a housing 171 comprising the extension of the container side walls beyond the end 55 of the container 13. The housing 171 surrounds and protects the sleeve 15 and valve member 111 from accidental, damaging contact. A slot 173 is formed in the housing 171 to provide clearance to allow the link member 131 to move freely therethrough.

The assembly of this invention simplifies the control of ink release from a container. All the parts of this assembly can be made from the same material, making the assembly easy to recycle. This invention also makes refilling the container easy because a member similar to the stationary member 27 can be inserted into the sleeve 15 to force ink back into the container.

Figure 5:
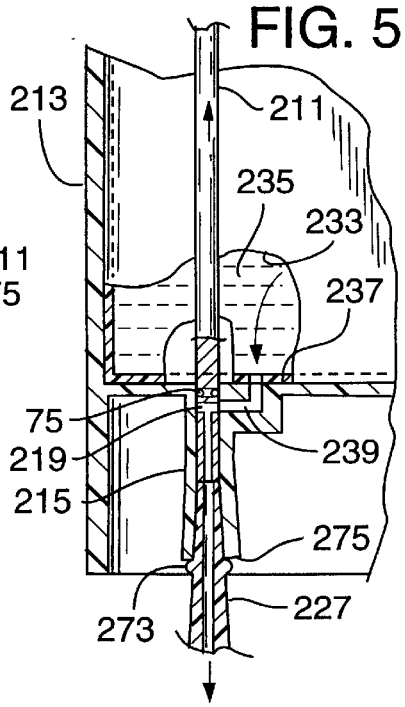
FIG. 5 is another embodiment of the invention where the ink container includes a collapsible bag containing the ink.

FIG. 5 shows an alternative embodiment in which the otherwise rigid container 213 includes an internal, collapsible ink bag 233. The ink bag 233 is attached to the container 213 in the vicinity of the valve member 211. This can be accomplished by heat staking a rectangular plastic sheet 235 to the bottom surface 237 of the container 213. After the plastic sheet 235 is attached to the bottom surface 237, the sheet is folded and sealed around its three edges to form the ink bag 233. Again, heat staking is used to provide the edge seal. When the plastic sheet 235 is attached to the bottom surface 237, it is fitted around the opening to the sleeve 215, so that the valve member 211 extends through the sleeve 215, but outside of the ink bag 233, between the bag 233 and the wall of the container 213. The upper side of the container 213 has an aperture, such as aperture 21 previously described, that allows the bag 233 to collapse as ink exits therefrom. The bag 233 encloses the ink from exposure to ambient air via the aperture.

The container 213 is provided with an L-shaped passageway 239 in the bottom surface 237. The passageway 239 connects the inside of the container 213 with the interior of the sleeve 215. When the valve member 211 is located in a closed position, the sides of the valve member 211 occlude the passageway 239 at the sleeve 215, preventing ink flow into the inlet 219. The valve member 211 can be moved into an open position in which the inlet 219 is aligned with the passageway 239, as illustrated in FIG. 5, thus allowing ink flow from the container 213.

In a preferred embodiment, the stationary member 227 that moves the valve member 211 into the open position is provided with a protruding, radial stop 273 that limits the upward travel of the valve member 211 so that when the stop 273 abuts the outermost edge 275 of the sleeve 215, the outlet 219 is aligned with the passageway 239. It is also contemplated that the stop 273 could be located on the upper end of the valve member 211 such that when the valve member 211 is stopped in its uppermost position, the outlet 219 is aligned with the passageway 239. The alignment can be accomplished either automatically, by pressing the assembly against the stationary member 227, or by manually moving the valve member 211 with either the grip 61 or the slide 29 as described above.

In the preferred embodiments, the lower ends of the valve members 11, 111, and 211 may be configured with an outer groove within which an O-ring 75 fits. The O-ring 75 enhances the seal between the valve members 11, 111, and 211 and sleeves 15 and 215, when the valve members 11, 111, and 211 are closed. It is contemplated, however, that the fit between the valve members 11, 111, and 211 and sleeves 15 and 215 may be made sufficiently tight to provide the seal without the use of the O-ring 75.

This description illustrates various embodiments of the present invention and should not be construed to limit the scope thereof in any way. Other modifications and variations may be made to the assembly described without departing from the invention as defined by the appended claims and their equivalents.

The invention claimed is:

1. An assembly for controlling the release of ink from an ink container, the assembly comprising:

an ink container for containing the ink, the ink container including an opening; and a valve member slidably mounted within the opening, the valve member having one end movable without rotation into a first position for occluding the opening to prevent the flow of the ink from the ink container and into a second position for allowing the flow out of the ink container.

2. The assembly of claim 1 in which the ink container also includes an aperture and in which the valve member has a second end slidably mounted in the aperture, the second end including a head and being movable into a closed position in which the head contacts the ink container to close the aperture and into an open position to open the aperture, thereby to provide fluid communication between the ink container and ambient air.

3. The assembly of claim 2 in which the aperture is sized to restrict passage of vapor out of the ink container.

4. The assembly of claim 1 wherein the one end of the valve member is exposed for contact with a protruding, stationary member, thereby to move the valve member into the second position when the container is moved against the stationary member.

5. The assembly of claim 1 further comprising a slide connected to the valve member and mounted on an exterior part of the container, the slide being movable for moving the valve member.

6. The assembly of claim 5 in which the slide is connected to the valve member by a link member carried on the container and arranged to transfer motion of the slide to the valve member.

7. The assembly of claim 1 in which the valve member includes a grip to allow manual movement of the valve member from the first position to the second position.

8. The assembly of claim 2 in which the valve member includes a grip to allow manual movement of the valve member from the first position to the second position.

9. An assembly for controlling the release of ink from an ink container, the assembly comprising:

an ink container for containing the ink, the ink container including an opening and an aperture remote from the opening; and a valve member slidably mounted within the opening, the valve member having one end movable into a first position for occluding the opening to prevent the flow of the ink from the ink container and into a second position for allowing the flow out of the ink container and wherein;

the valve member has a second end slidably mounted in the aperture, the second end including a head and being movable into a closed position in which the head contacts the ink container to close the aperture and into an open position to open the aperture, thereby to provide fluid communication between the ink container and ambient air.

10. The assembly of claim 9 in which the aperture is sized to restrict passage of vapor out of the ink container.

11. The assembly of claim 9 wherein the one end of the valve member is exposed for contact with a protruding, stationary member, thereby to move the valve member into the second position when the container is moved against the stationary member.

12. The assembly of claim 9 further comprising a slide connected to the valve member and mounted on an exterior part of the container, the slide being movable for moving the valve member.

13. The assembly of claim 12 in which the slide is connected to the valve member by a link member carried on the container and arranged to transfer motion of the slide to the valve member.

14. The assembly of claim 9 in which the valve member includes a grip to allow manual movement of the valve member from the first position to the second position.

15. An assembly for controlling ink release from a container, the assembly comprising:

a container having an interior, an exterior, and a passageway extending from the interior of the container;

a deformable bag substantially enclosed within the container, the bag having an interior for containing ink and being arranged such that the interior of the bag is in fluid communication with the passageway; and a valve member slidably mounted to the container outside the bag and being movable into a first position for occluding the passageway to prevent the flow of ink from the bag interior and into a second position for allowing ink flow from the interior of the bag through the passageway.

16. The assembly of claim 15 in which the valve member further includes an inlet extending through at least a portion of the valve member, the inlet aligning with the passageway in the second position so as to establish a path for fluid communication from the interior of the ink bag, through the passageway, through the inlet, and to the exterior of the container.

17. The assembly of claim 16 in which a wall of the container defines a hollow sleeve having an interior into which the passageway opens, and the valve member includes an inlet end that occludes ink flow from the passageway into the sleeve interior when the valve member is in the first position, the inlet being aligned with the passageway when the valve member is in the second position.

18. The assembly of claim 15 further comprising a stationary member insertable into the sleeve interior for moving the valve member from the first position to the second position.

19. The assembly of claim 18 in which the stationary member includes a stop that contacts the container to limit insertion of the stationary member into the sleeve interior.

20. The assembly of claim 15 further including an aperture extending between the interior and exterior of the container, and wherein a portion of the valve member is slidably mounted within the aperture, the portion being configured to occlude the aperture when the valve member is in the first position and to allow fluid communication between the interior of the ink container and ambient air when the valve member is in the second position.

21. The assembly of claim 20 in which the valve member further includes a head to occlude the aperture when the valve member is in the first position.

22. The assembly of claim 15 further comprising a slide mounted on the exterior of the container and connected to the valve member and movable to move the valve member.

* * * * *